US005150417A

United States Patent [19]

Stahl

[11] Patent Number: 5,150,417

[45] Date of Patent: Sep. 22, 1992

[54] BASS REFLEX TYPE SPEAKER SYSTEM

[75] Inventor: Karl-Erik Stahl, Varmdo, Sweden

[73] Assignee: Socon AB, Västeraås, Sweden

[21] Appl. No.: 660,056

[22] Filed: Feb. 25, 1991

[51] Int. Cl.[5] ..... H04R 25/00

[52] U.S. Cl. ..... 381/154; 381/159; 381/188; 181/156; 181/144

[58] Field of Search ..... 381/154, 159, 188, 205, 381/88, 89, 90; 181/156, 144, 148

[56] References Cited

U.S. PATENT DOCUMENTS 4,231,445 11/1980 Johnson ..... 181/148
4,933,982 6/1990 Tanaka ..... 381/154
4,953,655 9/1990 Furukawa ..... 381/159

*Primary Examiner*—Jin F. Ng
*Assistant Examiner*—Huyen D. Le

[57] ABSTRACT

A bass reflex speaker system with a ducted port which can be made without coloration in the mid frequency band of the speaker caused by standing wave resonances in the duct. The system includes one or more openings in the wall of the duct between the ends of the duct, and covering the openings with a deflectable membrane, such as a film of latex-like material, or a rigid membrane with a flexible surround. The additional openings prevent pressure build-up at a quarter wavelength location of undesirable standing waves, and thereby cancels the standing waves, but they do not affect the operation of the duct at the Helmholtz frequency of the bass reflex system.

17 Claims, 2 Drawing Sheets

BASS REFLEX TYPE SPEAKER SYSTEM

BACKGROUND OF THE INVENTION

The present invention relates to bass reflex speaker systems with ducted ports. Such speaker systems are well known in the art of loudspeaker design, and have been sold and used in the USA since 1938. A bass reflex system provides improved efficiency and lower frequency limit than a speaker with a closed cabinet. This is because it acts as a Helmholtz resonator, which supplies low frequency sound waves from the rear of the driver to the outside of the cabinet in phase with the direct sound waves from the front of the driver. The desired resonance frequency is determined by the air mass in the ducted port and the compliance of the air volume in the cabinet.

The duct alone, however, also can act as a resonator for sound waves with half-wave length equal to the length of the duct or a fraction thereof. This is an undesirable effect, because frequencies corresponding to such resonances will pass from the inside of the cabinet to the outside, and will color the midrange sound of the speaker. The audible effect of such undesirable resonances can be reduced or eliminated by forcing the sound across different parts of the cross section of the duct to travel different distances, or by adding a low-pass filter after the duct.

The first type of solution can be approximated by using a duct that is sharply bent. Another example of this type of solution is described in U.S. Pat. No. 4,933,982, which uses a straight duct containing coaxial inserts to force the sound waves to travel different distances between the input and exit openings. Both types of duct are, however, expensive to make, and the latter is quite bulky.

An example of the second type of solution is described in U.S. Pat. No. 4,953,655, where a bass reflex duct terminates in a separate chamber with a port to the outside of the cabinet. The separate chamber with its port acts as a low pass filter, which removes resonances in the duct before the sound from the duct is allowed to reach the outside of the speaker cabinet. The size, the complexity, and the cost of the speaker cabinet, however, are increased by the extra chamber.

SUMMARY OF THE INVENTION

An object of the present invention is to provide a bass reflex type speaker system which uses a ducted port, but does not suffer from undesirable leakage of mid-frequency signals from the interior of the speaker cabinet through the ducted port, and does not require complicated, bulky, or expensive designs of the duct or the speaker cabinet.

Additional objects and advantages of the invention will be set forth in part in the description which follows, and, in part, will be obvious from the description, or may be learned by practice of the invention. The objects and advantages of the invention may be realized and obtained by means of the instrumentalities and combinations particularly pointed out in the appended claims.

The objects of this invention are achieved by a bass reflex type speaker system comprising a cabinet, a driver mounted in the cabinet for transmitting sound waves inside the cabinet, a bass reflex port in a wall of the cabinet, a duct open at both ends mounted inside the cabinet with one end connected to the port, the duct having at least one additional opening between its ends, and a deflectable membrance covering the additional opening.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings.

Figure 1:
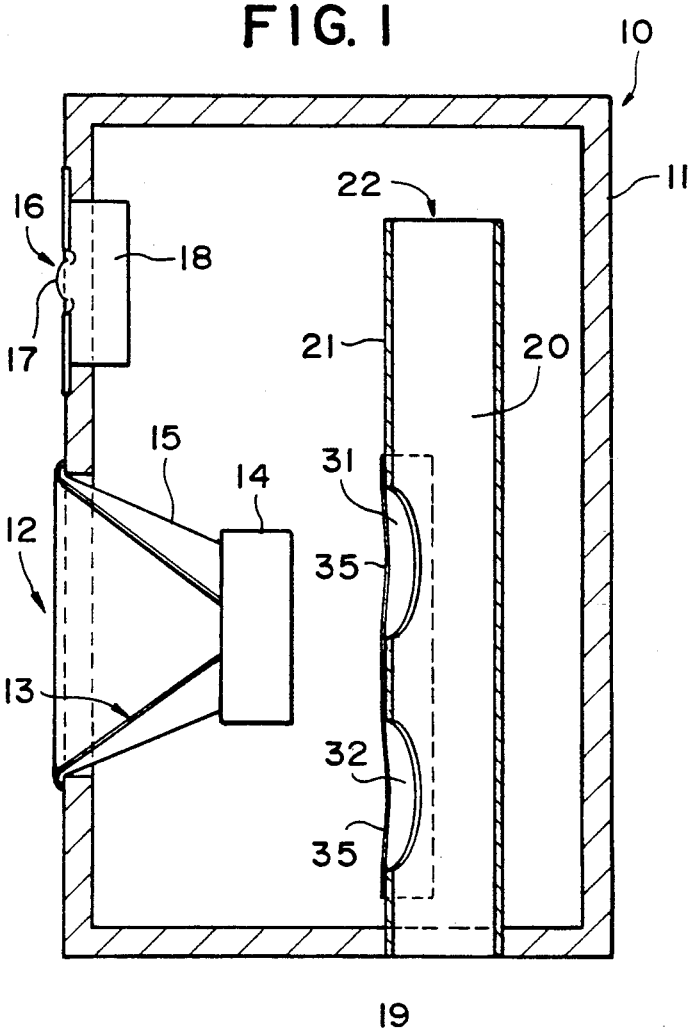
FIG. 1 is a vertical section through a first embodiment of a bass reflex speaker system according to the invention.

FIG. 1 shows a vertical section through a two-way bass reflex speaker system 10, comprising a speaker cabinet 11, a bass/midrange driver 12, a high frequency driver ("tweeter") 16, and a port 19. For the sake of clarity, components of a bass reflex speaker that do not relate to the invention, such as crossover filters for the driver 12 and tweeter 16, electrical wiring, and damping material for the speaker cabinet, are not shown in FIG. 1.

The bass/midrange driver 12 has a speaker cone 13 driven by a voice coil (not shown) in a magnet structure 14, which is supported by an acoustically open metal basket 15. The open end of the speaker cone 13 is connected to the basket 15 via a soft ring called a surround, which forms a seal between the speaker cone 13 and the outside of cabinet 11, but allows in/out movement of the speaker cone. The surround usually has the shape of a half-toroid, so the material can roll instead of stretching when the speaker cone 13 moves. The narrow end of the speaker cone 13 is connected to the magnet structure via a membrance with concentric corrugations called a spider. The surround and the spider allow a pure in/out motion of the speaker cone, so that when the voice coil of driver 12 is connected to output terminals of an audio amplifier, the front of the speaker cone 13 radiates directly to the outside of the cabinet, while the rear of the speaker cone 13 radiates 180° shifted sound through the open basket into the enclosed cabinet 11. The tweeter 16 has a dome 17 driven by a voice coil (not shown) inside a magnet structure 18. The dome 17 is supported by a surround, but usually there is no spider. When the voice coil of the tweeter is connected to output terminals of an audio amplifier, the front of the dome 17 radiates directly to the outside of the cabinet. The rear of the dome 17 radiates into a closed chamber housing the magnet structure, so the tweeter does not affect the sound pressure inside the cabinet 11.

Figure 3:
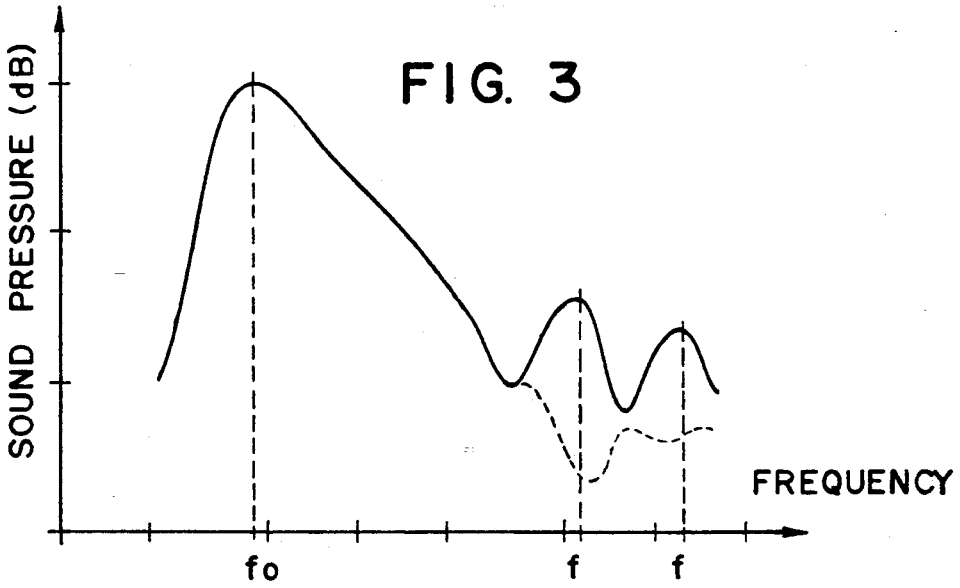
FIG. 3 is a graph showing sound pressure at the bass reflex port of the speaker system of FIG. 1 as a function of frequency for a duct with solid wall (solid line), and for a duct according to the invention (dotted line).

The inside of the cabinet 11 communicates acoustically with the outside only through the port 19, via an opening 22 in a duct 20 with wall 21 made of cardboard or plastic. The duct 20 and the interior of the cabinet form a Helmholtz resonator with a resonance frequency determined by the compliance of the air volume inside the cabinet 11 and the air mass inside the duct 20. The frequency response of the Helmholtz resonator, as measured at the port 19, will be as shown in FIG. 3. Sound with frequency $f_0$, equal to the resonance frequency of the Helmholtz resonator, passes through the port 19 with a phase shift of 180°, so the sound pressure at frequency $f_0$ from the port adds directly to the sound pressure from the front of the speaker cone 13. Sound of all other frequencies are attenuated. By selecting a resonance frequency $f_0$ about ½ actave lower than the roll-off frequency of driver 12, it is possible to get flat response to a bass frequency ½ octave lower than for a speaker with a closed cabinet without need for increased amplifier power, which is the object of a bass reflex speaker system.

If the duct 20 had wall 21 which was solid, as is common in the art, the frequency response curve will be as shown by the solid line in FIG. 3. Two undesirable resonance peaks appear at frequencies $f_1$ and $f_2$ in this case. In a speaker system with $f_0=42$ Hz using a duct 20 with length 250 mm and an inside diameter of 35 mm, resonance peaks were measured at $f_1=550$ Hz and $f_2=1200$ Hz when the duct 20 had a wall 21 which was solid. The velocity of sound in air at atmospheric pressure at 20° C. is 344 m/s, so sound at 550 Hz has a half-wave length of 313 mm, and sound at 1200 Hz has a half-wave length of 143 mm. The duct 20 is 250 mm long, which is close to one half-wave length and two half-wave lengths, respectively, at the two sound peaks. The two peaks at 550 Hz and 1200 Hz are thus clearly caused by standing waves in a duct 20 with a wall 21 which is solid.

The peak sound levels from the port 19 at frequencies $f_1$ and $f_2$ are much lower than the sound pressure from the front of the driver 12 at these frequencies, but in a high fidelity speaker system discrete peaks in the mid-range are audible as coloration of the sound even at very low levels.

Figure 2:
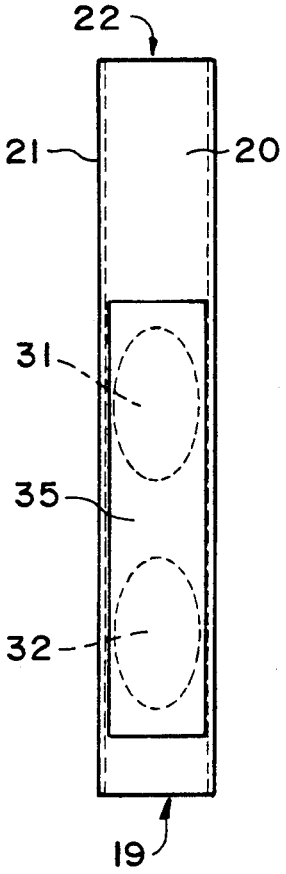
FIG. 2 is a view of the duct used in the speaker system of FIG. 1, as seen from the left side.

According to the invention, the standing waves in the duct 20 can be eliminated by using a duct 20 with wall 21 provided with additional openings 31, 32 covered by deflectable membrances 35, such as an elastic film, as shown in FIGS. 1 and 2. The frequency response of the Helmholtz resonator of the system of FIG. 1, with a duct 20 with film covered openings 31, 32 in the wall 21 is shown by the dotted line in FIG. 3. The peaks at 550 Hz and 1200 Hz are eliminated, and a much smoother frequency response is obtained throughout the mid-range frequencies.

The openings 31, 32 are located close to where the peak pressure variations would appear in the duct 20 at the frequencies to be attenuated. Opening 31 is thus close to the ¼ wave location at frequency $f_1$, and opening 32 is close to the ¼ wave location at frequency $f_2$. The film 35 can be in the form of a flat sheet glued to the outside of wall 21 of the duct 20, as shown in FIGS. 1 and 2, or it can be made in the form of a sleeve threaded over the wall 21, with ties to keep it in place.

The film forming the membrances 35 should be sufficiently compliant to make each membrance act as an opening in the duct at frequencies $f_1$ and $f_2$, but stiff enough to make the membrance act as a seal at the Helmholtz resonance $f_0$. The acoustic impedance of a membrance with given compliance is inversely proportional to frequency, so the large ratio between $f_1$ or $f_2$ and $f_0$ makes it easy to achieve this effect. A thin latex film works well, but it tends to age and become brittle. A 0.025 mm thick polyurethane film, sold under the trade name Walopur, is stable over time, and was used in the speaker system with frequency response as shown by the dotted line in FIG. 3. Other suitable film materials are available on the open market.

Latex film has very little elastic damping, so it is necessary to add damping material to avoid uncontrolled oscillations of the film covering openings 31, 32 when latex film is used. This can be achieved by wrapping loosely twisted fibers of cotton or cotton-like material around the outside of duct 20 so it lightly touches the film over openings 31, 32. Other methods for adding damping to the film can be used in cases where the film material itself is insufficiently damped. Polyurethane film has sufficient inherent damping, so no external damping is required for this type of film.

Figure 4:
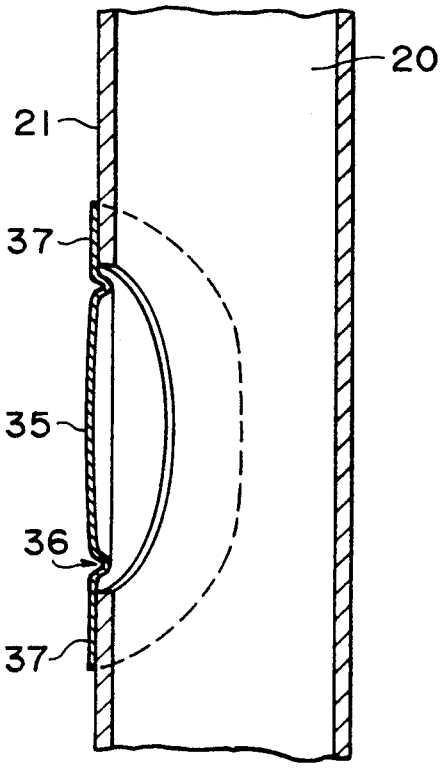
FIG. 4 is a vertical section through an inelastic membrance mounted on a duct of a second embodiment of a bass reflex speaker system according to the invention.
Figure 5:
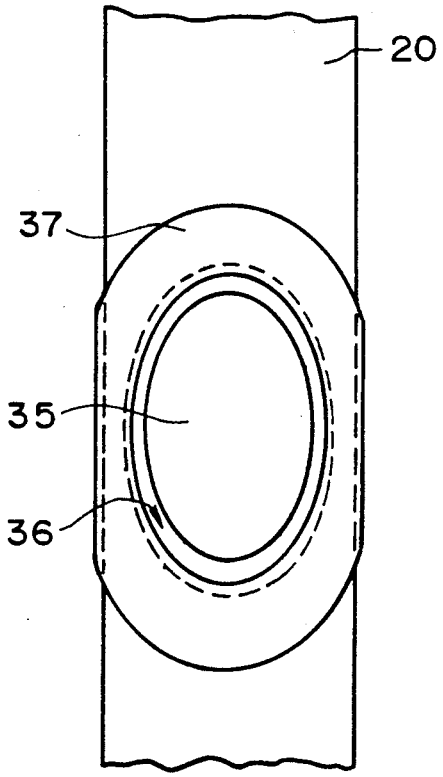
FIG. 5 is a front view of the membrance shown in FIG. 4 mounted on a duct.
Figure 6:
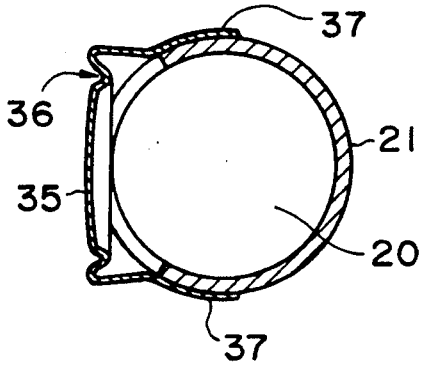
FIG. 6 is a horizontal section through the membrance shown in FIG. 4 mounted on a cylindrical duct.

The deflectable membrances 35 can also be made from a substantially inelastic material, such as shown in FIGS. 4 through 6. FIGS. 4–6 show an inelastic membrane 35 according to the invention, mounted on a cylindrical duct 20 with walls 21 again having openings. The inelastic membrane 35 has been made deflectable by means of a surround 36, which is formed around the periphery of the membrane 35. The surround 36 allows in/out deflection of the membrane 35 in the same way as the surround for an ordinary speaker cone. The surround 36 can be formed in the same material as the membrane, or it can be made of a different material by gluing to the membrane 35. Outside the surround 36 are sections 37 for mounting and sealing the membrane 35 with surround 36 to the wall 21 of the duct 20. The function of a deflectable membrane of the type shown in FIGS. 4–6 is the same as for a deflectable membrane formed by a simple elastic film, as described above with reference to FIGS. 1 and 2.

When the duct 20 is cylindrical, as shown in FIGS. 4–6, the mounting section 37 must be formed into a relatively complicated shape as shown in FIG. 6, because the entire surround 36 must lie in a plane to function properly. In cases where the duct 20 has a flat wall section, the mounting sections can be coplanar with the membrane 35 and the surround 36, so the movable membrane 35 with surround 36 and mounting section 37 can be formed very simply from a thin sheet of plastic material, for instance by hot pressing.

A deflectable membrane made from an inelastic material, as illustrated in FIGS. 4–6, is more complicated to make than a simple elastic film, but its cost is still very low, and it makes it possible to use a wide range of materials that are not available as elastic films.

The number of openings (31, 32) required in the wall 21 of the duct 20 will vary from case to case, depending on the length of the duct 20 and upper crossover frequency for the bass/midrange driver 12. One opening will suffice in many cases, and rarely will more than three openings be required. The invention is not limited to a certain number of openings.

Thus, it is intended that the present invention cover the modifications and variations in the bass reflex type speaker system in accordance with the invention within the scope of the appended claims and their equivalents and without limitation to the different environments.

What is claimed is:

1. A bass reflex type speaker system, comprising:
(a) a cabinet;
(b) a driver mounted in said cabinet for transmitting sound waves inside said cabinet;
(c) a bass reflex port in a wall of said cabinet;
(d) a duct open at both ends and mounted inside said cabinet with one end connected to said port, said duct having an additional opening between its ends; and
(e) a deflectable membrane covering said additional opening.

2. A bass reflex type speaker system according to claim 1, wherein said deflectable membrane is formed by an elastic film.

3. A bass reflex type speaker system according to claim 2, further comprising means for dampening resonances in said elastic film.

4. A bass reflex type speaker system according to claim 2, wherein said elastic film is made from polyurethane.

5. A bass reflex type speaker system according to claim 1, wherein said deflectable membrane comprises a rigid membrane and a surround for supporting and allowing movement of said rigid membrane.

6. A bass reflex type speaker system according to claim 1, wherein said duct is a substantially straight tube.

7. A bass reflex type speaker system according to claim 1, wherein said additional opening is located at a distance from said port substantially equal to one quarter of the wavelength of a standing wave in said duct.

8. A bass reflex type speaker system according to claim 7, wherein said deflectable membrane is formed by an elastic film.

9. A bass reflex type speaker system according to claim 7, wherein said deflectable membrane comprises a rigid membrane and a surround for supporting and allowing movement of said rigid membrane.

10. A bass reflex type speaker system according to claim 1, wherein said duct has a number of additional openings predetermined by the length of the duct and an upper crossover frequency for said driver.

11. A bass reflex type speaker system according to claim 10, wherein said deflectable membrane is formed by an elastic film.

12. A bass reflex type speaker system according to claim 10, wherein said deflectable membrane comprises a rigid membrane and a surround for supporting and allowing movement of said rigid membrane.

13. A bass reflex type speaker system according to claim 1, wherein said deflectable membrane has a compliance that is sufficiently high to make said membrane act substantially as an opening in said duct at frequencies corresponding to standing waves in said duct.

14. A bass reflex type speaker system according to claim 13, wherein said deflectable membrane is formed by an elastic film.

15. A bass reflex type speaker system according to claim 13, wherein said deflectable membrane comprises a rigid membrane and a surround for supporting and allowing movement of said rigid membrane.

16. A bass reflex type speaker system according to claim 1, wherein said duct has a flat wall section.

17. A bass reflex type speaker system according to claim 16, wherein said deflectable membrane comprises a rigid membrane and a surround for supporting and allowing movement of said rigid membrane.

* * * * *